US008509659B2

(12) United States Patent
Sawano

(10) Patent No.: US 8,509,659 B2
(45) Date of Patent: Aug. 13, 2013

(54) IMAGE FORMING APPARATUS

(75) Inventor: Ichiro Sawano, Izumisano (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 263 days.

(21) Appl. No.: 13/130,874

(22) PCT Filed: Nov. 13, 2009

(86) PCT No.: PCT/JP2009/069361

§ 371 (c)(1), (2), (4) Date: May 24, 2011

(87) PCT Pub. No.: WO2010/061741

PCT Pub. Date: Jun. 3, 2010

(65) Prior Publication Data

US 2011/0243615 A1 Oct. 6, 2011

(30) Foreign Application Priority Data

Nov. 27, 2008 (JP) ..... 2008-302212

(51) Int. Cl.
*G03G 15/09* (2006.01)

(52) U.S. Cl.
USPC ..... 399/269; 399/276; 399/277

(58) Field of Classification Search
USPC ..... 399/119, 252, 265–271, 276, 277
See application file for complete search history.

(56) References Cited

U.S. PATENT DOCUMENTS 6,735,410 B2 5/2004 Sekiguchi
6,879,800 B2 * 4/2005 Mabuchi et al. ..... 399/269
6,975,825 B2 * 12/2005 Sakamaki et al. ..... 399/269
7,224,917 B2 5/2007 Julien et al.
7,660,551 B2 * 2/2010 Ramesh et al. ..... 399/269
2002/0181974 A1 12/2002 Sekiguchi
2003/0156862 A1 8/2003 Nishimura
2005/0163539 A1 7/2005 Nishimura
2006/0216049 A1 9/2006 Julien et al.

FOREIGN PATENT DOCUMENTS

JP 05-150636 6/1993
JP 2002-351211 A 12/2002
JP 2003-167424 A 6/2003
JP 2003-337472 A 11/2003
JP 2005-037523 A 2/2005
JP 2006-276853 A 10/2006
JP 2007-163766 A 6/2007

OTHER PUBLICATIONS

International Search Report in International Application No. PCT/JP2009/069361, mailed Jan. 12, 2010, 2 pages.

* cited by examiner

*Primary Examiner* — Hoan Tran

(74) *Attorney, Agent, or Firm* — Brinks Hofer Gilson & Lione

(57) ABSTRACT

The image forming apparatus is provided with first spacing members having an outer diameter larger than that of a first developing roller, which first spacing members are disposed at two ends of the first developing roller coaxially with the first developing roller, second spacing members having an outer diameter larger than that of a second developing roller, which second spacing rollers are disposed at two ends of the second developing roller coaxially with the second developing roller, a first retaining member, a second retaining member, a first biasing member, a second biasing member.

12 Claims, 8 Drawing Sheets

IMAGE FORMING APPARATUS

This application is a National Stage of International Application PCT/JP2009/069361 filed with Japanese Patent Office on Nov. 13, 2009.

TECHNICAL FIELD

The present invention relates to an image forming apparatus.

BACKGROUND ART

Heretofore, as a developing method in an image forming apparatus using an electrophotographic method, there have been known a single-component developing method using only toner as a developer, and a two-component developing method using toner and carrier.

The single-component developing method is advantageous in aspects of simplification, smaller in size, and a lower cost of an apparatus, while toner degradation is likely to be accelerated due to heavy stress at a control section where toner is charged, and charge receptivity of toner is likely to be lowered. Further, since a toner regulating member or a surface of a developing roller is contaminated by toner or external additives, a charge providing property to toner is decreased to result in shorter service life of the developing device.

In the two-component developing method, since toner is triboelectrically-charged by being mixed with carrier, stress on toner is small, and therefore, the method has an advantage in preventing toner from being degraded. Further, since the surface area of carrier is large, the method is also relatively resistant to contamination with toner or external additives, and is advantageous in terms of longer service life.

However, in the two-component developing method, since the surface of an image carrier is rubbed by a magnetic brush formed of the developer when an electrostatic latent image on the image carrier is developed, traces of the magnetic brush can be produced, and furthermore, carrier is likely to be adhered to the image carrier, resulting in a problem of image defects.

As a developing method to solve a problem of image defects while having a characteristic of a long life of the two-component developing method, there is disclosed a so-called hybrid developing method in which two-component developer is carried on a sleeve roller, and only toner is supplied from the two-component developer to a developing roller, which toner is then used for development (refer to Patent Document 1).

However, in the hybrid developing method, if the gap between the image carrier and the developing roller, that is, a developing nip, varies, the electric field intensity in the developing nip varies, and whereby the degree of development of an electrostatic latent image on an image carrier also varies. For that reason, in order to obtain an appropriate image density, a structure stably securing a uniform gap between the image carrier and the developing roller is required.

Further, in order to form a thin toner layer composed of an appropriate amount of toner on the surface of developing roller, a structure stably securing a uniform gap in the shaft direction between the developing roller and the sleeve roller is required.

To cope with such issues, disclosed is an image forming apparatus which is provided with a rotation shaft holding unit having a pair of openings in which rotation shafts of a magnetic roller and a developing roller are integrally fit so as to be rotatably hold, and the opening of the developing roller side is made swingable around the shaft of the magnetic roller side (refer to Patent Document 2).

Further, disclosed is an image forming apparatus in which a gear is provided on each of a developing roller and a magnetic roller, and driving force is transferred from the magnetic roller to the developing roller through an idling gear, which is held on a rotation shaft holding member which swings around the shaft centers of the developing roller and the magnetic roller, whereby each of gaps among a magnetic roller, a developing roller, and an image carrier is made uniform (refer to Patent Document 3).

In addition, disclosed is an image forming apparatus in which a magnetic roller, a developing roller, and a gap pulley are rotatably held, a movable bearing which holds a developer control plate is provided, and the movable bearing is urged toward the image carrier, whereby each of gaps among a magnetic roller, a developing roller, and an image carrier is made uniform (refer to Patent Document 4).

On the other hand, in the hybrid developing method, a bias voltage is applied between a developing roller and a sleeve roller to transfer only toner to the developing roller, and only toner is made to jump from the surface of the developing roller to a latent image on an image carrier. However, as the speed of image formation becomes faster, it has become difficult for a sufficient amount of toner to jump, which results in a problem of decrease in density of a toner image.

To cope with such problems, there is disclosed an image forming apparatus which can control, even in the case where an image carrier is rotated in a high speed, a decrease in toner density due to such high speed by transferring toner in a plurality of times with arranging a plurality of developing milers (refer to Patent Document 5).

RELATED ART DOCUMENT

Patent Documents

Patent Document 1: Japanese Laid-open Patent Application Publication No. H5-150636

Patent Document 2: Japanese Laid-open. Patent Application Publication No. 2003-167424

Patent Document 3: Japanese Laid-open Patent Application Publication No. 2003-337472

Patent Document 4: Japanese Laid-open Patent Application Publication No. 2007-163766

Patent Document 5: Japanese Laid-open Patent Application Publication No. 2005-37523

SUMMARY OF THE INVENTION

Object of the Invention

In the case of an image forming apparatus equipped with two developing rollers and a developing device separately structured, in order to facilitate exchange for maintenance, uniform gaps in the shaft direction are stably secured between the image carrier and each of the developing rollers when the developing device is attached to the main body of the image forming apparatus.

In particular, in the case of a hybrid developing method, setting is made so that two developing rollers appropriately share the amount of development to form an image and to reproduce a fine image pattern. Therefore, if the gaps between each of the developing rollers and the image carrier fluctuate, the sharing balance of development is lost. Accordingly, there is a problem of image failures such as irregularity of image density and fog are likely to be generated.

However, in Patent Document 5, there is no disclosure of a constitution in which a developing device is provided with a plurality of developing rollers and is detachably mounted on the main body of the image forming apparatus, and each of gaps between the image carrier and each of the two developing rollers is made stably uniform in the shaft direction.

Further, in an image forming apparatus disclosed in Patent Documents 2 to 4, there is disclosed a constitution which has a single developing roller, and in which the developing device is constituted to be detachable, and each of the gaps among a magnetic roller, a developing roller, and an image carrier is made uniform, but it cannot be applied to the developing device having two developing rollers.

The present invention is conceived in consideration of the above issues, and it is an object to provide an image forming apparatus in which each of gaps between an image carrier and two developing rollers is kept in a prescribed clearance by a simple constitution to suppress image failures, and whereby, high quality images can be obtained.

Measures for Solving The Object

To solve the above-mentioned problems, the present invention has the following features.

Item 1. An image forming apparatus, comprising:

an image carrier;

a developing device including:

a first developing roller and a second development roller configured to develop an electrostatic latent image on the image carrier with a thin toner layer formed on surfaces thereof; and a magnet roller having:

a magnet body fixedly provided; and a sleeve roller which is rotatable and internally including the magnet body, and the sleeve roller is configured to carry and convey toner on a circumference thereof so as to supply the toner to the first developing roller and the second developing roller which face the sleeve roller, wherein the image forming apparatus comprises:

first spacing members which are provided coaxially with the first developing roller, on respective ends of the first developing roller, and the first spacing members have a larger diameter than the first developing roller;

second spacing members which are provided coaxially with the second developing roller, on respective ends of the second developing roller, and the second spacing members have a larger outer diameter than the second developing roller;

a pair of first retaining members which integrally retain respective rotation shafts of the sleeve roller and the first developing roller with a predetermined clearance;

a pair of second retaining members which rotatably hold a rotation shaft of the second developing roller and are swingably mounted on the rotation shaft of the sleeve roller;

a first biasing member configured to urge the first spacing members so as to bring the first spacing members in contact with the image carrier; and a second biasing member configured to urge the second spacing members so as to bring the second spacing members in contact with the image carrier.

Item 2. The imaging apparatus of item 1, wherein a developing device housing of the developing device is configured to be movable in a direction in which the spacing members contact the image carrier, and the first biasing member urges the developing device housing.

Item 3. The imaging apparatus of item 1 or 2, wherein an amount of toner supplied from the magnetic roller to the first developing roller is larger than the second developing roller is supplied.

Item 4. The imaging apparatus of item 3, wherein the first developing roller is disposed upstream in a conveyance direction in which the developer is conveyed by the magnet roller.

Item 5. The imaging apparatus of any one of items 1 to 4, wherein the first developing roller is disposed upstream from the second developing roller in a moving direction of the image carrier.

Item 6. The imaging apparatus of any one of items 1 to 5, comprising:

a pair of third spacing members which are provided coaxially with the sleeve roller at positions which are on the respective ends of the sleeve roller, and at which the third spacing members can contact with the first developing roller, and the third spacing members have a diameter larger than a diameter of the sleeve roller, and the first retaining members are configured to hold the rotation shaft of the first developing roller to be movable in a normal line direction of the sleeve roller.

Item 7. The imaging apparatus of any one of items 1 to 6, comprising:

a pair of third spacing members which are provided coaxially with the sleeve roller at positions which are on the respective ends of the sleeve roller, and at which the third spacing members can contact with the second developing roller, and the third spacing members have a diameter larger than a diameter of the sleeve roller, and the second retaining members are configured to hold the rotation shaft of the second developing roller to be movable in a normal line direction of the sleeve roller.

Advantage of the Invention

According to the present invention, a first spacing member having an outer diameter larger than that of a first developing roller is mounted on the first developing roller, and a second spacing member having an outer diameter larger than that of a second developing roller is mounted on the second developing roller, and then, the first spacing member and the second spacing member are urged so that they make close contacts with an image carrier. With this simple construction, there is provided an image fanning apparatus, in which each of the gaps between an image carrier and the two respective developing rollers is kept in a prescribed space to suppress image failures, and whereby, a high quality image can be obtained.

BRIEF DESCRIPTION OF ME DRAWINGS

Figure 4A:
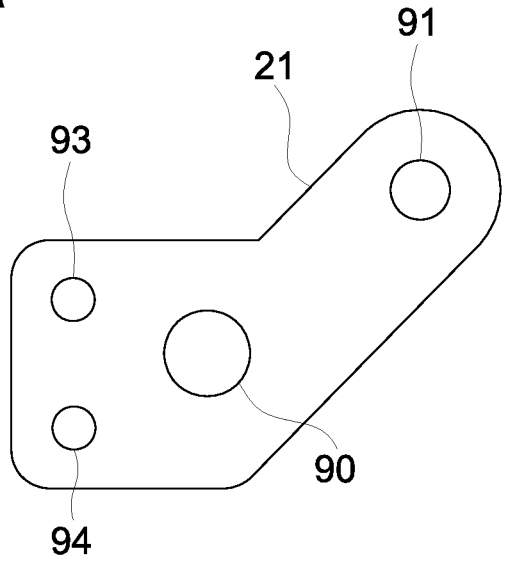
Figure 4B:
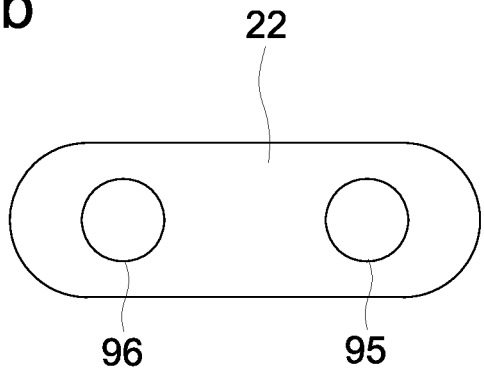
Figure 5A:
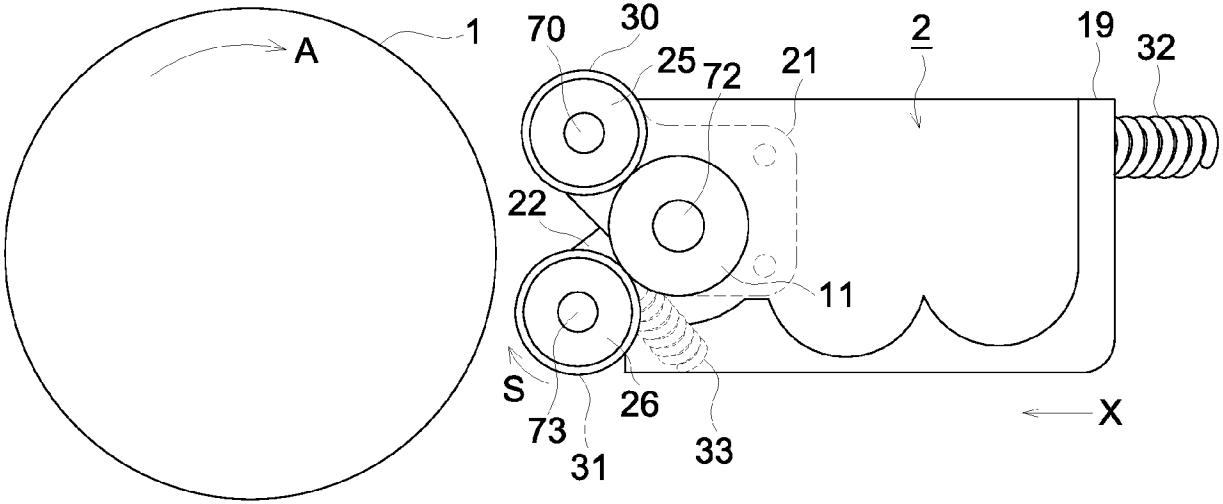
Figure 5B:
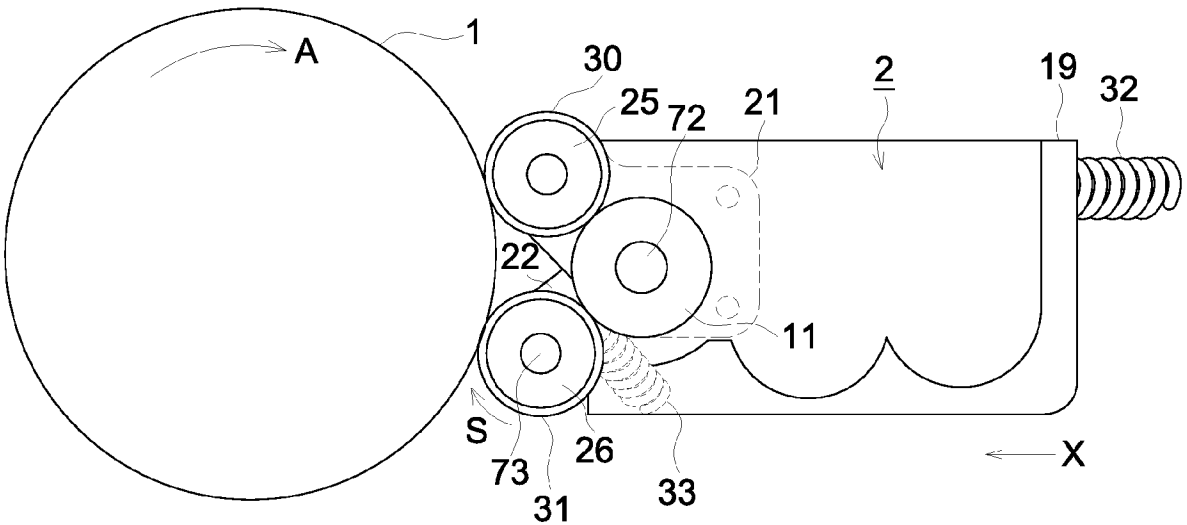
Figure 6:
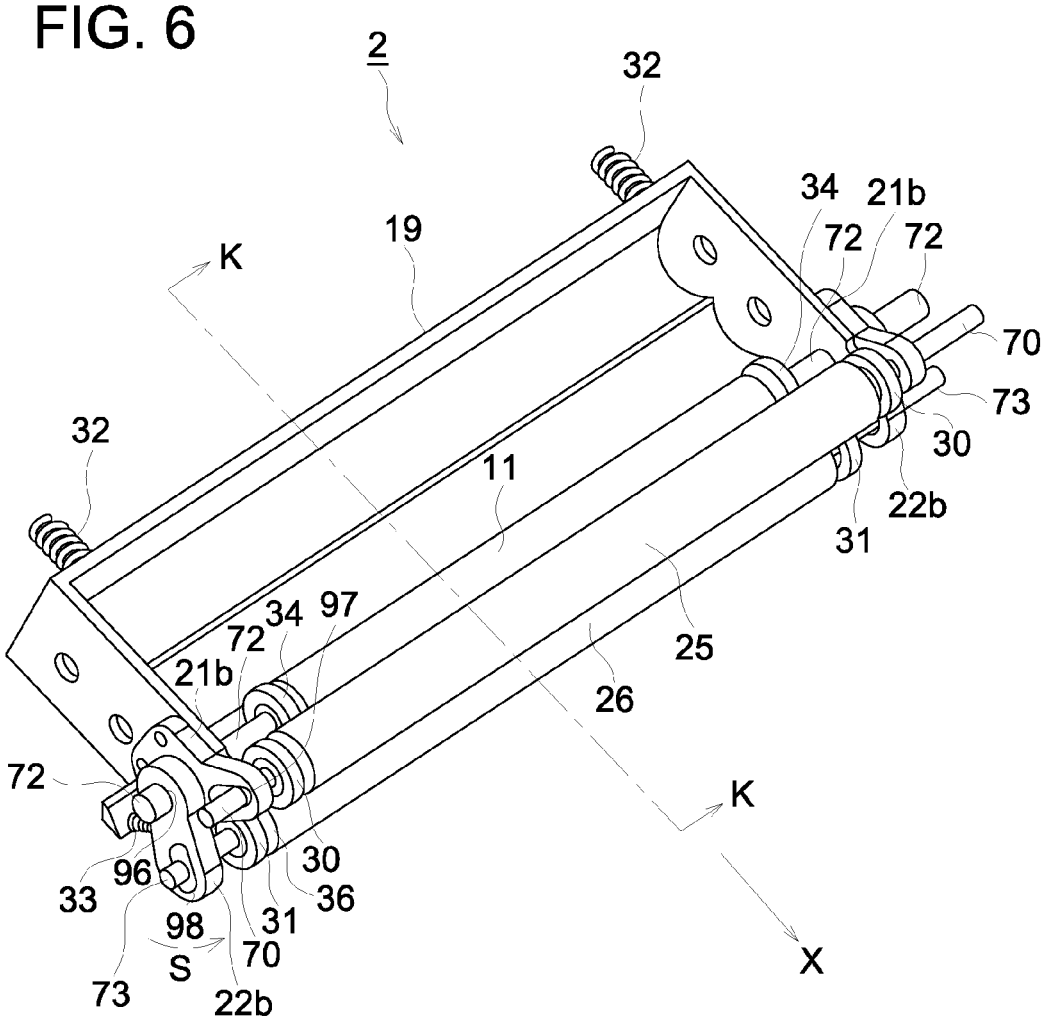
Figure 7A:
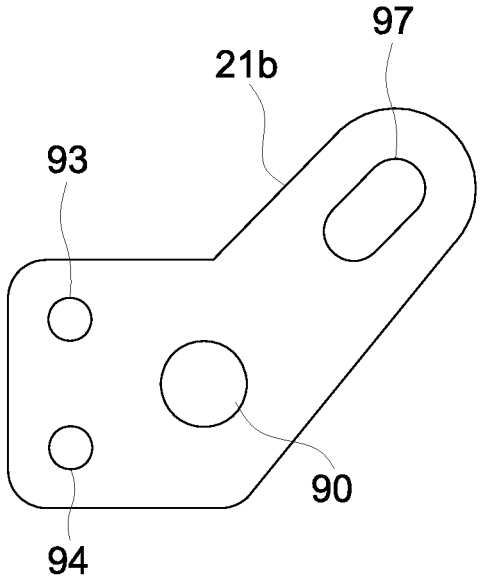
Figure 7B:
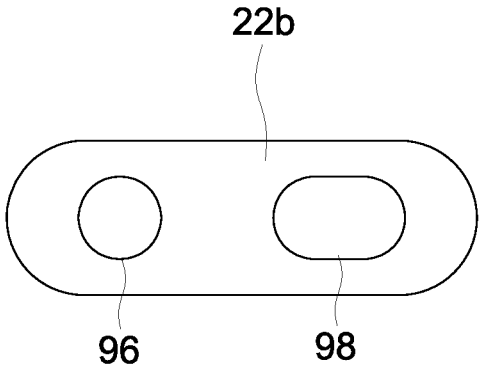
Figure 8A:
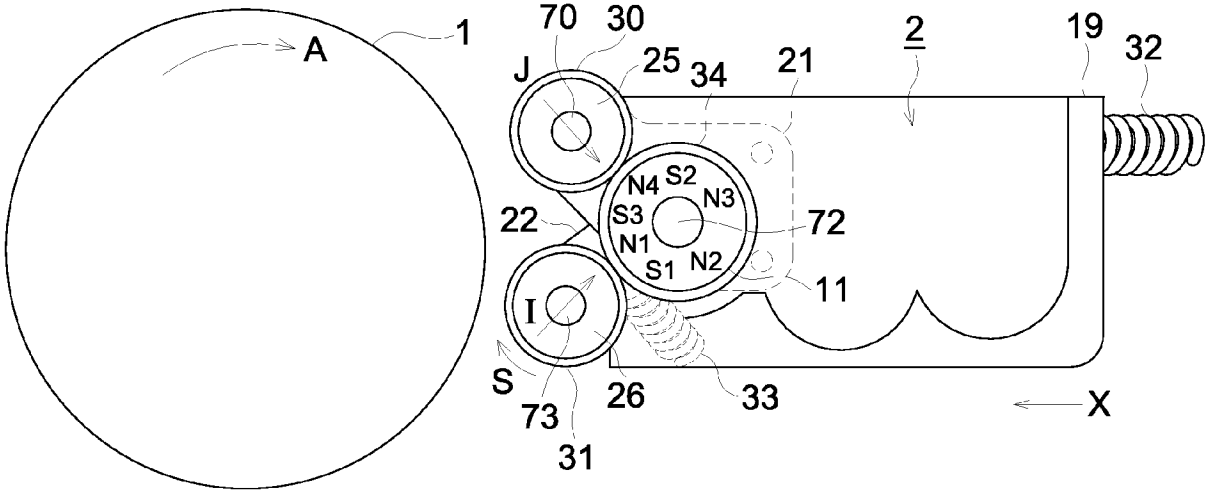
Figure 8B:
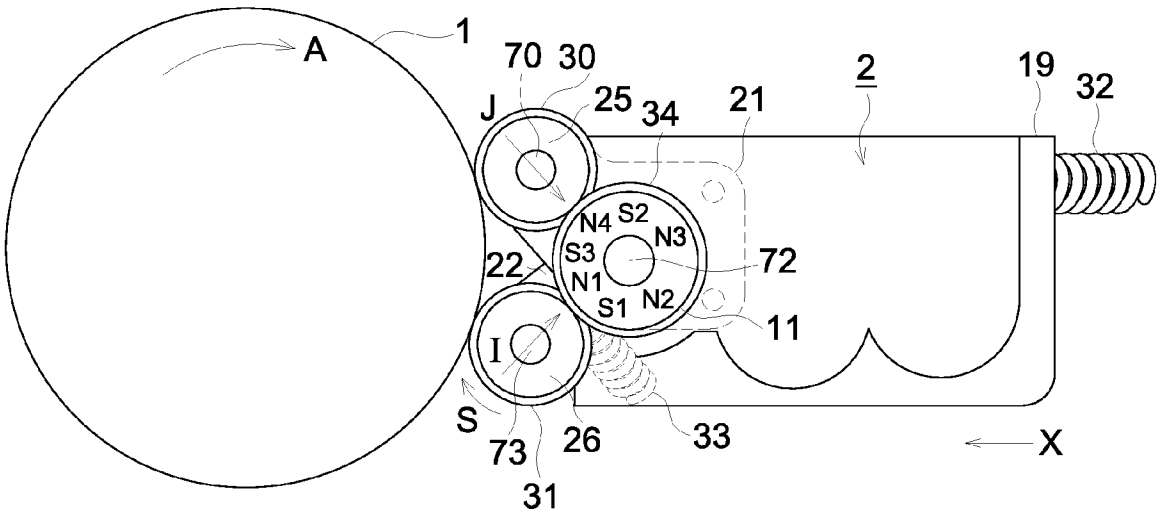
Figure 9:
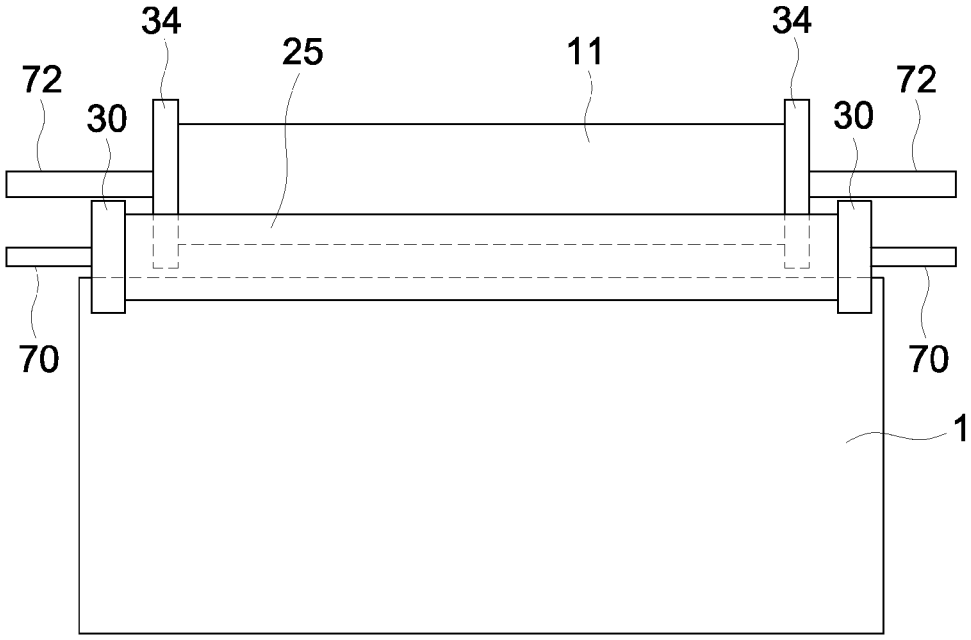

FIGS. 4*a* and 4*b* are plan views of a first holding member 21 and a second holding member 22 of the first embodiment;

FIGS. 5*a* and 5*b* are diagrams showing behaviors when the developing device 2 of the first embodiment is attached to the image forming apparatus;

FIG. 6 is the external view of the developing device 2 of a second embodiment;

FIGS. 7*a* and 7*b* are plan views of a first holding member 21 and a second holding member 22 of the second embodiment;

FIGS. 8*a* and 8*b* are diagrams showing behaviors when the developing device 2 of the second embodiment is attached to the image forming apparatus; and FIG. 9 is a plan view showing a positional relationship among a Mag roller 11, a first developing roller 25, and the image carrier 1.

BEST MODE FOR CARRYING OUT THE INVENTION

Hereinafter, embodiments of the present invention will be described with reference to the drawings.

(Construction and Operation of Image Forming Apparatus)

Figure 1:
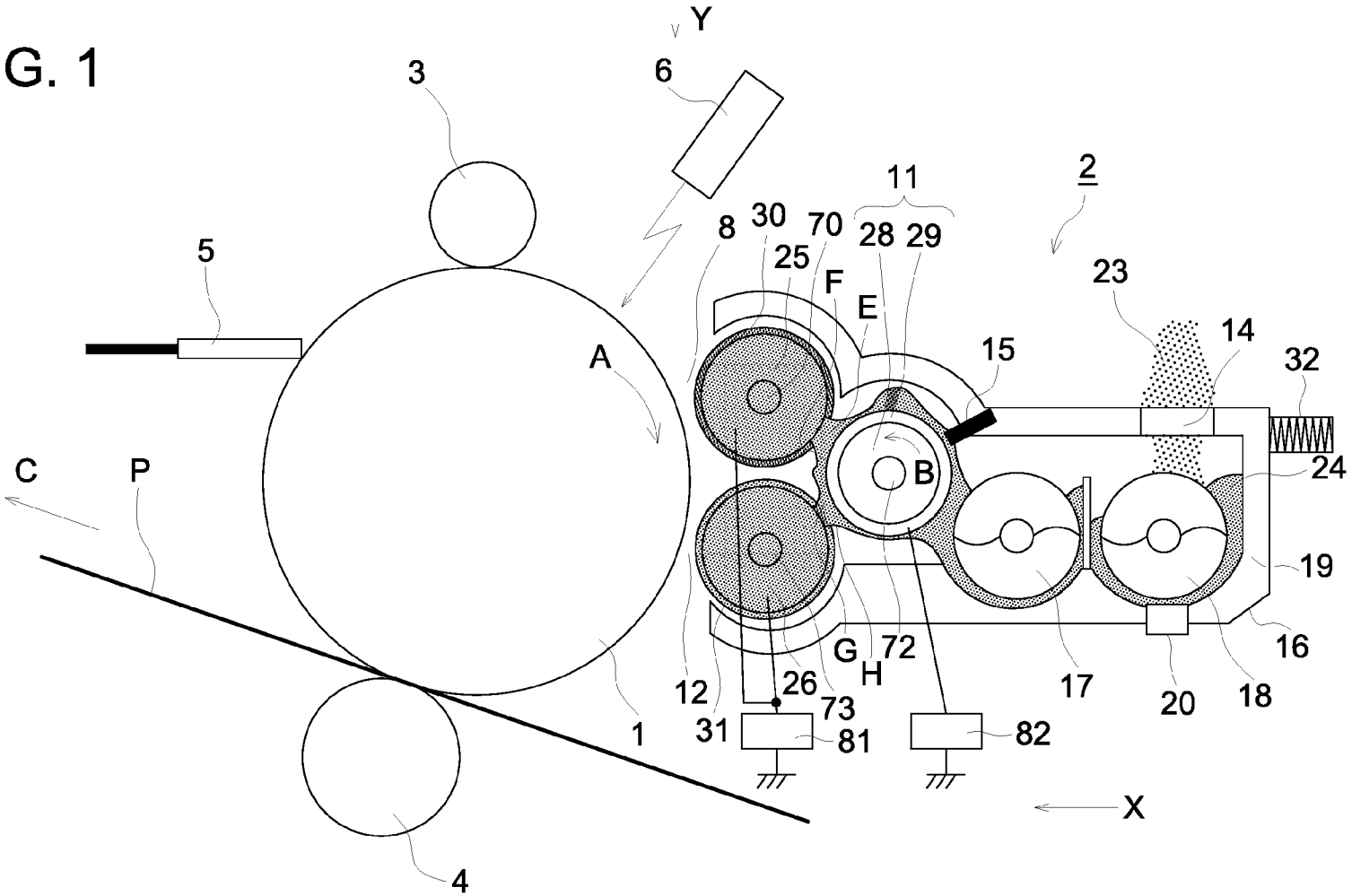
FIG. 1 is a cross-sectional view showing a developing device 2 of an embodiment according to the present invention and an structural example of a major part of an image forming apparatus provided with the developing device 2.

FIG. 1 shows an example of configuration of a major part of an image forming apparatus according to an embodiment of the present invention. With reference to FIG. 1, a schematic construction and operations of the image forming apparatus will be described.

The present image forming apparatus is a printer which transfers a toner image formed on an image carrier (photoreceptor) 1 by an electrophotographic method onto transfer medium P, such as a sheet of paper, to form an image.

The present image forming apparatus has an image carrier 1 for carrying an image, and, around the image carrier 1, there are arranged, in the following order along direction A of the rotation of the image carrier 1, a charging member 3 for charging the image carrier 1, a developing device 2 for developing a latent image on the image carrier 1, a transfer roller 4 for transferring a toner image on the image carrier 1, and a cleaning blade 5 for removing residual toner on the image carrier 1.

The mage carrier 1 is exposed by an exposure device 6 provided with a laser emitting device and the like after it is charged by the charging member 3, and whereby, an electrostatic latent image is formed on the surface of the image carrier 1. The developing device 2 develops the electrostatic latent image to form a toner image. The transfer roller 4 transfers the toner image formed on the image carrier 1 onto a transfer medium P, and then ejects the medium P in arrow C direction shown in the figure. The cleaning blade 5 removes toner, after transfer, remaining on the image carrier 1 by a mechanical force.

For the image carrier 1, the charging member 3, the exposure device 6, the transfer roller 4, the cleaning blade 5, and the like which are used in the image forming apparatus, commonly known technologies of electrophotographic method may be arbitrarily used. For example, as the charging member 3, a charging roller is shown in the figure, but it may be a charging device which does not contact with the image carrier 1. Further, for example, the cleaning blade 5 may not be used.

A developing device housing 19 of the developing device 2 is constructed movably in arrow X direction or its reverse direction along a non-illustrated guide arranged on the body side of the image forming apparatus, and is made detachable.

One ends of first urging members 32 are fixed on the main body of the image forming apparatus, and the other ends urge the developing device housing 19 in the arrow X direction, and bring the first spacing members 30 into contact with the image carrier 1. For the first urging member 32, a compression coil spring, a stretching coil spring, and the like is desirably used, but the spring is not particularly limited thereto, and a torsion spring or a thin plate spring, or rubber, which is an elastic body, may be used.

Next, with reference to FIGS. 1 to 5*b*, a structural example of developing device 2 of the hybrid developing method relating to the first embodiment will be described.

The main components of the developing device 2 are a developer tank 16, a Mag roller 11, a first developing roller 25, and a second developing roller 26.

Figure 2:
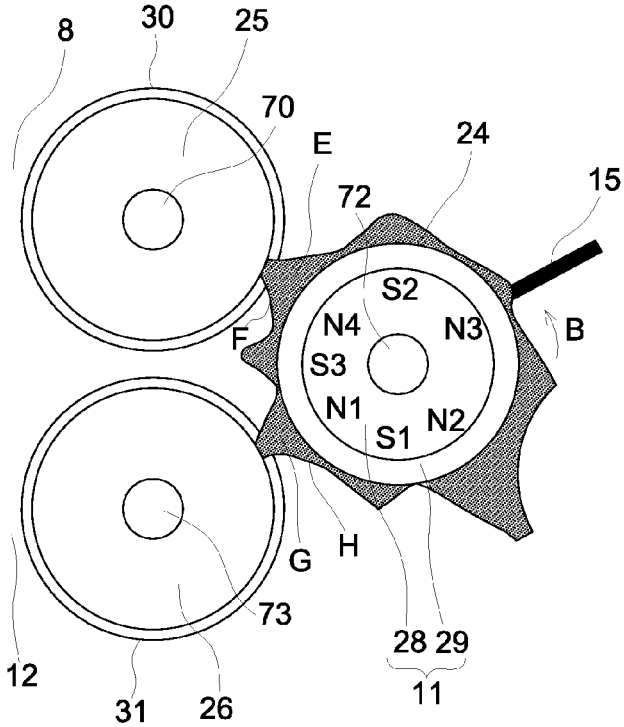
FIG. 2 is a partially enlarged cross-sectional view of major elements of the developing device 2.
Figure 3:
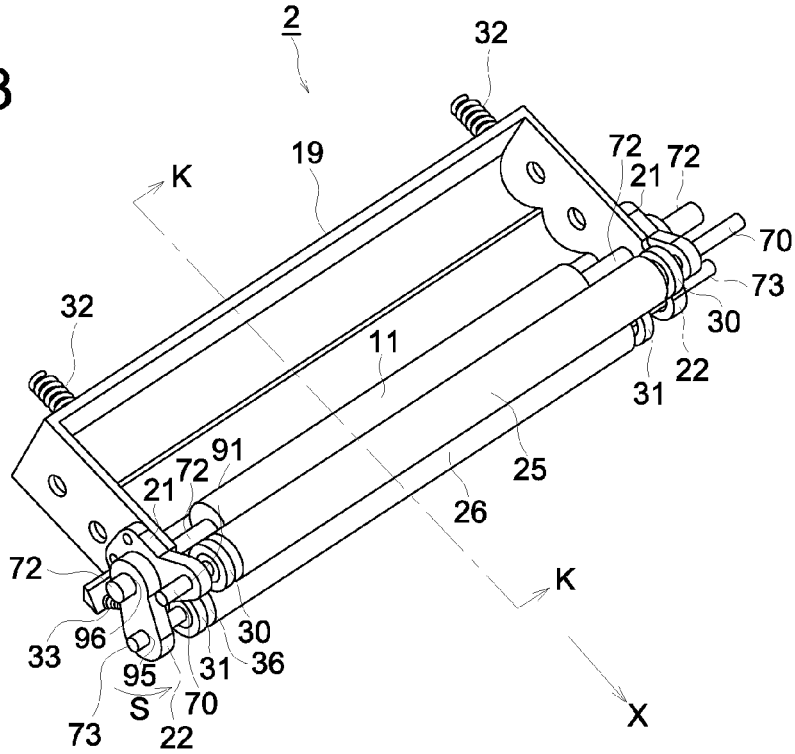
FIG. 3 is the external view of the developing device 2 of the first embodiment.

FIG. 2 is a partially enlarged cross-sectional view of the major components of the developing device 2 shown in FIG. 1, FIG. 3 is an external view of the developing device 2 of the first embodiment. FIGS. 4*a* and 4*b* are plan views of the first holding member 21 and the second holding member 22 of the first embodiment. FIGS. 5*a* and 5*b* are diagrams showing behaviors when the developing device 2 of the first embodiment is attached to the image forming apparatus. The cross-sections of the developing device 2 shown in FIGS. 1, 5*a*, and 6*b* are cross-sections along arrow KK in FIG. 3.

Hereinafter, with reference to FIG. 1, the developing device 2 of the first embodiment will be described.

The developer tank 16 accommodates developer 24 which contains toner 23 and carrier.

The developing device housing 19 is provided with a replenishment section 14 for replenishing the toner 23 of the amount equivalent to that consumed in a first developing area 8 and a second developing area 12 to the developer tank 16. The toner 23 fed from a non-illustrated hopper storing the toner 23 is replenished from the replenishment section 14 to the developing tank 16. The replenishment of the toner 23 is controlled based on an output of ATDC (Automatic Toner Density Control) sensor 20 used for detection of toner density.

In the interior of the developing device housing 19, mixing and stirring members 17 and 18 are arranged. The mixing and stirring members 17 and 18 mix and stir the developer 24 to provide triboelectric charging thereto, and supplies the developer 24 to the Mag roller 11.

The Mag roller 11 is made up of a fixedly arranged magnetic body 28 and a rotatable sleeve roller 29 which contains the magnetic body 28, and at the time of image formation, a toner feeding bias voltage for supplying the toner 23 to the first developing roller 25 and the second developing roller 26 is applied by a Mag roller biasing power source 82. Since the sleeve roller 29 is connected with a rotation shaft 72 of Mag roller 11, when the rotation shaft 72 is rotated by a non-illustrated motor, the sleeve roller 29 accordingly rotates. The Mag roller 11 is the magnetic roller of the present invention.

The developer 24, which was supplied to the Mag roller 11, is held on the surface side of the sleeve roller 29 by a magnetic force of the magnetic body 28, and rotatably moves in the arrow B direction along with the sleeve roller 29. A regulation member 15 is arranged at a position facing the sleeve roller 29, and regulates the amount of developer 24 held on the surface side of the sleeve roller 29 to a prescribed amount.

The magnetic body 28 has seven magnetic poles, S3, N1, S1, N2, N3, S2, and N4, along the rotation direction of the sleeve roller 29 as shown in FIG. 2. Of these magnetic poles, N4 is arranged at a position of a first toner feeding area E facing the first developing roller 25 and N1 is arranged at a position in a second toner feeding area G facing the second developing roller 26, respectively.

Further, in order to generate a repulsive magnetic field for peeling off the developer 24 on the sleeve roller 29 N2 and N3 are arranged on the side of the mixing and stirring member 17.

In the present embodiment, the first developing roller 25 and the second developing roller 26 are arranged upstream and downstream in the conveying direction of developer 24, respectively. Each of the first developing roller 25 and the second developing roller 25 conveys the toner 23 by holding the toner on its periphery, and then, transfers the toner to develop an electrostatic latent image formed on the image carrier 1.

A developing roller biasing power source 81 supplies a development bias voltage to the first developing roller 25 and the second developing roller 26. Further, the Mag roller biasing power source 82 supplies a toner feeding bias voltage to the sleeve roller 29 of the Mag roller 11.

The developing device 2 of the present embodiment uses a two-component developer containing the toner 23 and carrier. The toner and the carrier frictionally contact with each other, and as a result, the toner 23 and the carrier are assumed to be charged to the minus polarity and plus polarity, respectively. Further, it is assumed that the circumferential surface of the image carrier 1 is charged to minus (for example, −500 V), and the toner is attached to a portion where the electric potential is decreased (for example, −50 V) by exposure, and as a result, the development is completed. In this case, for example, the development bias voltage and the toner feeding bias voltage are set to −300 V and −350 to −650 V, respectively.

In this arrangement, by applying voltages to the first developing roller 25, the second developing roller 26, and the sleeve roller 29, in the first toner feeding area E between the Mag roller 11 and the first developing roller 25, an electric field is formed to attract the negatively charged toner from the Mag roller 11 toward the first developing roller 25. Further, in the toner feeding area G between the Mag roller 11 and the second developing roller 26, an electric field is formed to attract the toner 23 from the Mag roller 11 toward the second developing roller 26.

The first developing roller 25 and the second developing roller 26 may be made of any materials as long as the above voltage can be applied, and the roller may include, for example, an aluminum roller being subjected to a surface treatment, such as an anodized aluminum. There may be used other material which is subjected to resin coating on a conductive substrate such as aluminum. The coating material includes, for example, polyester resin, polycarbonate resin, acryl resin, polyethylene resin, polypropylene resin, urethane resin, polyamide resin, polyimide resin, polyester resin, polyetherketone resin, or vinyl chloride resin. In addition, there may be used material which is coated with resin such as vinyl acetate resin, silicone resin, and fluororesin, or is coated with rubber such as silicone rubber, urethane rubber, nitrile rubber, natural rubber, and isoprene rubber. The coating material is not limited to them.

Further, an electrical conducting agent may be added to the bulk or the surface of the above coating. The electrical conducting agent includes an electron conducting agent or an ion conducting agent. The electron conducting agent includes carbon black such as Ketjen black, acetylene black, and furnace black, metal powder or fine particles of metal oxide, without being limited thereto. The ion conducting agent includes a cationic compound such as quaternary ammonium, an amphoteric compound, or other ionic polymeric material, without being limited thereto. Furthermore, the roller may be a conductive roller made of metal materials such as aluminum.

The first spacing member 30 has a ring shape, and is arranged at the respective ends of the first developing roller 25 so that it rotates slidingly on the rotation shaft 70 of the first developing roller 25. The radius of the periphery of the first spacing member 30 is set to be larger than that of the first developing roller 25 by a prescribed space (0.1 mm to 0.4 mm) which corresponds to a gap necessary between the image carrier 1 and the first developing roller 25.

The second spacing member 31 has a ring shape, and is arranged at the respective ends of the second developing roller 26 so that it rotates slidingly on the rotation shaft 73 of the second developing roller 26. The radius of the periphery of the second spacing member 31 is set to be larger than that of the second developing roller 26 by a prescribed space (0.1 mm to 0.4 mm) which corresponds to a gap necessary between the image carrier 1 and the second developing roller 26.

The first spacing member 30 and the second spacing member 31 are desirably constituted by a low friction member. The low friction member may be integrally formed of a low friction coefficient resin material such as polyacetal, or otherwise, and for the circumferential surface where the image carrier 1 slides or for the bearing portion where rotation shaft 70 and rotation shaft 73 slide, there may be used a metal material which is coated with Teflon (a trade mark) and the like. Further, commercially available ball bearings may be incorporated in the bearing portion.

On the respective sides of the developing device housing 19, there are provided non-illustrated bearing portions, which rotatably hold the rotation shaft of the Mag roller 11, and the assembled rotation shaft 72 of the Mag roller 11 is held by the bearing portions protruding from the developing device housing 19.

As shown in FIG. 4*a*, the first holding member 21 has bearing portions 90 and 91 to integrally and rotatably hold the rotation shaft 72 of the Mag roller 11 and the rotation shaft 70 of the first developing roller 25 with a prescribed space therebetween. The rotation shaft 72 protruding from the developing device housing 19 is held by the bearing portion 90 in the first holding member 21. Further, the rotation shaft 70 of the first developing roller 25 is held by the bearing portion 91 in the holding member 21. The gap between the bearing portion 90 and the bearing portion 91 is set so that the gap between the surface of the Mag roller 11 and the surface of the first developing roller 25 may be a prescribed value (0.2 mm to 1.0 mm).

The first holding members 21 are positioned and fixed on the developing device housing 19 by a non-illustrated positioning section such that the main magnetic pole N4 of the magnetic body 28 fixed on the developing device housing 19 faces the first developing roller 25. Holes 93 and 94 are holes to fix the holding member 21 on the developing device housing 19 with bolts. The first holding members 21 may be integrally formed together with the developing device housing 19.

With the holding members 21, the gap between the surface of the first developing roller 25 and the surface of the sleeve roller 29 of the Mag roller 11 is accurately maintained, and the first developing roller 25 can be accurately kept at a position facing the main magnetic pole N4 of the magnetic body 28.

As shown in FIG. 4*b*, the second holding member 22 has bearing portions 95 and 96 to integrally and rotatably hold the rotation shaft 73 of the second developing roller 26 and the rotation shaft 72 of the Mag roller 11 with a prescribed space therebetween. The rotation shaft 72 protruding from the developing device housing 19 is held by the bearing portion 96 in the second holding member 22. The gap between the bearing portion 95 and the bearing portion 96 of the second holding member 22 is set so that the gap between the surface of the sleeve roller 29 of the Mag roller 11 and the surface of the second developing roller 26 may be a prescribed value (0.2 mm to 1.0 mm).

One ends of the second urging members 33 are fixed on the developing device housing 19, and the other ends urge the second holding members 22 in the arrow S direction so that the spacing members 31 arranged at the both ends of the second developing roller 26 may be in close contact with the image carrier 1.

For the second urging member 33, it is desirable to use a compression coil spring, a stretching coil spring, and the like, but the spring is not particularly limited, and a torsion spring or a thin plate spring, or rubber, which is an elastic body, may be used.

It is constructed in such a way that the rotation shafts 72, 70, and 73 are connected to each other with non-illustrated gears, and then, the first developing roller rotates in conjunction with the second developing roller by the rotating rotation shaft 72 by a non-illustrated motor.

Next, with reference to FIGS. 5*a* and 5*b*, behaviors when the developing device 2 is attached to the image forming apparatus will be described. FIG. 5*a* shows a state before the developing device 2 attached to the image forming apparatus, and FIG. 5*b* shows a state after the developing device 2 was attached to the image forming apparatus.

As described above, since the developing device housing 19 is urged in the arrow X direction by the first urging member 32, the developing device housing 19 moves as shown in FIG. 5*b*, and then, the first spacing members 30 arranged at both ends of the first developing roller 25 make a close contact with the surface of the image carrier 1. Then, between the surface of the image carrier 1 and the surface of the first developing roller 25, a gap, which is equivalent to the difference between the radius of the first spacing member 30 and the radius of the first developing roller 25, is formed. In this way, when the first spacing member 30 is brought into a close contact with the image carrier 1 by urging the developing device housing 19 having the first holding members 21, errors depending on the deviation or the circularity of the image carrier 1 can be eliminated, and the gap between the surface of the image carrier 1 and the surface of the first development roller 25 is accurately maintained.

On the other hand, since the second holding members 22 are urged in the arrow S direction by the second urging members 33, the second spacing members 31 arranged at both ends of the second developing roller 26 make a close contact with the surface of the image carrier 1 which is rotatably fixed to the image forming apparatus as shown in FIG. 5*b*.

This arrangement produces a gap, which is equivalent to the difference between the radius of the second spacing member 31 and the radius of the second developing roller 26, between the surface of the image carrier 1 and the surface of the second developing roller 26. In this way, when the second spacing members 31 are brought into a close contact with the image carrier 1 by urging the second holding member 22, errors depending on the deviation or the circularity of the image carrier 1 is eliminated, and the space between the surface of the image carrier 1 and the surface of the second development roller 26 is accurately maintained.

Next, with reference to FIG. 1, operations of the developing device 2 will be described.

The developer 24 in the developing tank 16 is mixed and stirred by rotation of the mixing and stirring members 17 and 18, and is circularly conveyed in the developing tank and is triboelectrically charged, and then, supplied to the sleeve roller 29 located on the surface of the Mag roller 11. This developer 24 is held on the surface side of the sleeve roller 29 by a magnetic force of the magnetic body 28 existing in the Mag roller 11 for supplying toner, and is rotationally moved along with the sleeve roller 29, and the passing amount of the developer 24 is regulated by the regulation member 15 arranged facing the Mag roller 11.

The developer 24, which passed through the regulation member 15 and is held on the surface side of the sleeve roller 29, is conveyed, with rotation of the sleeve roller 29, to the first toner feeding area E facing the first developing roller 25. In the first toner feeding area E, a bristle of developer is formed by the magnetic force of the main magnetic pole N4 of the magnetic body 28, and the toner 23 in the developer 24 is fed to the first developing roller 25 side by a force given to the toner 23 from the electric field which is formed by the development bias voltage applied to the first developing roller 25 and the toner feeding bias voltage applied to the Mag roller 11.

The toner 23 fed to the first developing roller 25 is conveyed to the first developing area 8 with rotation of the first developing roller 25, and an electrostatic latent image is developed to be a visual image by an electric field formed by a development bias voltage and a latent image voltage on the image carrier. The development method may be a reverse development method or a regular development method.

The toner 23 on the surface of the first developing roller 25, from which toner was consumed in the first development area 8, is conveyed to a first recovery area F along with the rotation of the first developing roller 25. In the first recovery area F, undeveloped toner 23 remaining on the first developing roller 25 is recovered from the first developing roller 25 to the Mag roller 11. The undeveloped toner 23 moves from the first developing roller 25 to the surface of the sleeve roller 29 by an electrostatic force created by an electric field formed by a voltage applied to the first developing roller 25 and a voltage applied to the Mag roller 11, and an electric field formed by a counter charge of developer, and by a mechanical rubbing force by a bristle of developer formed by a magnetic force of the main magnetic pole N4 of the Mag roller 11.

The developer 24 which contains the toner 23 having been recovered on the surface of the sleeve roller 29 is, along with the rotation of the sleeve roller 29, conveyed to the second toner feeding area G which faces the second developing roller 26.

In the second toner feeding area G, a bristle of developer is formed by the magnetic force of the main magnetic pole N1 of the magnetic body 28, and toner in the developer is fed to the second developing roller 26 side by a force given to the toner and generated by an electric field fanned by the development bias voltage applied to the second developing roller 26 and the toner feeding bias voltage applied to the Mag roller 11.

The toner layer fed to the second developing roller 26 is conveyed to the second developing area 12 along with the rotation of the second developing roller 26, and a second development is carried out. The toner layer on the surface of the second developing roller 26, from which toner was consumed in the second development area 12, is conveyed to a second recovery area H, and is recovered from the second developing roller 26 to the Mag roller 11.

The recovered developer 24 is rotationally conveyed toward the developer tank 16, and then, separated from the upper part of the Mag roller 11 by a repulsive magnetic field of the homopolar magnetic poles N2 and N3 to be recovered in the developer tank 16. When a non-illustrated replenishment control section provided for the replenishment section 14 detects, based on an output value of ATDC sensor 20, that the toner density in developer 24 became below the minimum toner density for securing an image density, the toner 23 having been stored in the hopper is supplied in the developer tank 16 through the toner replenishment section 14 by a non-illustrated toner replenishment means.

In this way, in the present embodiment, the Mag roller 11 supplies the toner 23 to the first developing roller 25 which is arranged upstream in the direction of conveying developer 24, and then the Mag roller 11 recovers the post-development residual toner remaining on the first developing roller 25 into the developer 24 on the Mag roller 11, and then, supplies the toner 23 to the second developing roller 26 which is arranged downstream. Thus, since the amount of toner on the surface of the first developing roller 25 is larger than that on the surface of the second developing roller 26, the first developing roller 25 has a heavier burden of supply and recovery of the toner 23.

In the present embodiment, the rotation shaft 70 of the first developing roller 25 is held by the first holding members 21, which are fixed to the developing device housing 19, and the rotation shaft 70 is accurately maintained at the position which the main magnetic pole N4 of the magnetic body 28 faces, and therefore, it is possible to recover the entire toner remaining on the first developing roller 25 and to eliminate a development history (ghost).

Further, since the first developing roller 25 is arranged upstream in the moving direction of the image carrier 1 (in the arrow A direction), the toner can be sufficiently supplied to the image carrier 1.

Under normal conditions, the amount of toner on the surface of the developing roller on the upstream side is larger, but if conditions such as a voltage applied to the developing roller, the surface resistance value of the developing roller, and the rotation speed of the developing roller are changed between the upstream side and the downstream side, the amount of toner on the surface of the developing roller on the downstream side can be increased.

In the present embodiment, since the amount of toner on the surface of the first developing roller 25 on the upstream side is larger, the first developing roller 25 is made to be held by the holding member 21 which is fixed to the developing device housing 19. On the other hand, in the case where the amount of toner on the surface of developing roller of downstream side is larger, the developing roller of downstream side may be held by a holding member which is fixed to the developing device housing 19, and the developing roller on the upstream side may be held by a holding member which is swingable around the rotation shaft 72.

Next, with reference to FIGS. 6 to 9, a structural example of a developing device 2 of the hybrid developing method relating to the second embodiment will be described. The same functional elements as those of the first embodiment are denoted by the same numerals, and their descriptions will be omitted.

FIG. 6 is the external view of the developing device 2 of the second embodiment, FIGS. 7*a* and 7*b* are plan views of a first holding member 21*b* and a second holding member 22*b* of the second embodiment, and FIGS. 8*a* and 8*b* are diagrams showing behaviors when the developing device 2 of the second embodiment is attached to the image fanning apparatus. The cross section of the developing device 2 shown in FIGS. 8*a* and 8*b* are the cross section along arrow KK in FIG. 6.

The developing device 2 of the second embodiment differs from that of the first embodiment in the following points: the developing device 2 has third spacing members 34 at the respective ends of the Mag roller 11; and the rotation shafts 70 and 73 are held to be movable in the normal line direction of the Mag roller 11.

Hereinafter, the details will be described with reference to the figures.

The third spacing member 34 has a ring shape, and is arranged at each of both ends of the Mag roller 11 so that it rotates slidingly with the first developing roller 25. The radius of the periphery of the third spacing member 34 is set larger than that of the Mag roller 11 by the amount of a prescribed space (0.2 mm to 1.0 mm) which is a necessary gap between the Mag roller 11 and the first developing roller 25.

In the present embodiment, the size of the gap between the Mag roller 11 and the second developing roller 26 is same as that of the gap between the Mag roller 11 and the first developing roller 25, and the third spacing member 34 is arranged so that it rotates slidingly on the second developing roller 26 too.

The circumferential surface of the third spacing member 34 is desirably formed by a low friction member similar to the first and second spacing members 30 and 31. The low friction member may be integrally formed of a resin material having a low frictional coefficient such as polyacetal, or there may be used a metal material coated with Teflon (a trade mark) for the circumferential surface on which the image carrier 1 slides or for bearing portions where rotation shafts 70 and 73 slide. Further, commercially available ball bearings may be incorporated in the bearing portions.

In the first holding member 21*b*, the shape of the bearing portion 97, which holds the rotation shaft 70 of the first developing roller 25 is, as shown in FIG. 7*a*, is made to be oval so that the rotation shaft 70 can be moved in the normal line direction of the Mag roller 11. The developing device 2, to which the first holding member 21*b* is attached, is constituted, as shown in FIG. 8*a*, such that the rotation shaft 70 of the first developing roller 25 is movable along bearing portion 97 in an arrow J direction or its reverse direction. The arrow J direction is the normal line direction of the Mag roller 11, and is the direction toward the main magnetic pole N4 of a magnetic body 28 of the Mag roller 11.

When the developing device housing 19 is urged by the first urging member 32 to be moved in an arrow X direction, and whereby, the first spacing member 30 makes a close contact with the image carrier 1, the rotation shaft 70 is moved in the arrow J direction, and the first developing roller makes a close contact with the third spacing member 34.

In this way, when the spacing member 34 is brought into a close contact with the surface of the first developing roller 25, errors depending on the deviation or the circularity of the first developing roller 25 can be eliminated, and the gap between the surface of the first developing roller 25 and the surface of the sleeve roller 29 of the Mag roller 11 is accurately maintained.

There may be arranged, if necessary, an urging member which urges the first developing roller 25 in the direction toward the spacing member 34.

Similarly, in the second holding member 22*b*, the shape of a bearing portion 98, which holds the rotation shaft 73 of the second developing roller 26 is, as shown in FIG. 7*b*, is made to be oval so that the rotation shaft 73 can be moved in the normal line direction of the Mag roller 11. The developing device 2, to which the second holding member 22*b* is attached, is constituted, as shown in FIG. 8*a*, such that the rotation shaft 73 of the second holding member 22 is movable in an arrow I direction or its reverse direction along the bearing portion 98. The arrow I direction is the normal line direction of the Mag roller 11, and is the direction toward the main magnetic pole N1 of the magnetic body 28 of the second developing roller 26.

The developing device housing 19 is moved in the arrow X direction being urged by the first urging member 32, and when the second spacing member 31, which is urged by a second urging member 33, makes a close contact with the image carrier 1, the rotation shaft 73 is moved in an arrow I direction, and whereby, the second developing roller 26 makes a close contact with the third spacing member 34.

In this way, when the spacing member 34 is brought into a close contact with the surface of the second developing roller 26, errors depending on the deviation or the circularity of the second developing roller 26 can be eliminated, and the gap between the surface of the second developing roller 26 and the surface of the sleeve roller 29 of the Mag roller 11 is accurately maintained.

There may be arranged, if necessary, an urging member which urges the second developing roller 26 in the direction towards the spacing member 34.

FIG. 9 is a plan view showing a positional relationship among the Mag roller 11, the first developing roller 25, and the image carrier 1. In the present embodiment, the length of the first developing roller 25 in the horizontal direction in the figure is longer than that of the Mag roller 11. The second developing roller 26, which is not illustrated in FIG. 9, has the same length as the first developing roller 25. The third spacing members 34 are attached to the positions where the third spacing members 34 make close contact with the first developing roller 25 and the second developing roller 26.

The present embodiment is configured so that the third spacing members 34 abut on the first developing roller 25 and the second developing roller 26, but it may be configured so that the third spacing members 34 abut on either one of the developing rollers. For example, in the case where the third spacing members 34 abut on the developing roller 25 and does not abut on the second developing roller 26, there may be used the first holding members 21*b* having a bearing portion 97 with an oval shape shown in FIG. 7 and the second holding members 22 having a bearing portion 95 with a circular hole shape shown in FIG. 4.

As described above, according to the present invention, it is possible to provide an image forming apparatus in which the size of each of the gaps between the image carrier and the two developing rollers are kept in a prescribed space by a simple configuration to control image failures, and whereby, an high quality image is obtained.

DESCRIPTION OF THE NUMERAL

1: Image carrier
2: Developing device
3: Charging member
4: Transfer roller
5: Cleaning blade
6: Exposure device
11: Mag roller
12: Second development area
16: Developer tank
17, 18: Mixing and stirring member
19: Developing device housing
20: ATDC sensor
21, 21*b*: First holding member
22, 22*b*: Second holding member
23: Toner
24: Developer
25: First developing roller
26: Second developing roller
28: Magnetic body
29: Sleeve roller
30: first spacing member
31: second spacing member
32: First urging member
33: Second urging member
81. Developing roller biasing power source
82: Mag roller biasing power source
E: First tonner feeding area
F: First recovery area
G: Second tonner feeding area
H: Second recovery area

The invention claimed is:

1. An image forming apparatus, comprising:

an image carrier configured to carry an electrostatic latent image on a surface thereof; and a developing device, including:

a first developing roller and a second developing roller each configured to carry a toner layer formed on a surface thereof, wherein the electrostatic latent image on the surface of the image carrier is developed with the toner layer;

a magnetic roller which has a fixedly arranged magnetic body and a rotatable sleeve roller containing the magnetic body therein, and which is provided to be opposed to the first and second developing rollers and is configured to carry and convey developer containing toner and carrier particles on an outer circumferential surface thereof to feed the toner in the developer to the first and second developing rollers;

a pair of first spacing members each of which is provided coaxially with the first developing roller at each end of the first developing roller, wherein each of the first spacing members has a larger outer diameter than the first developing roller;

a pair of second spacing members each of which is provided coaxially with the second developing roller at each end of the second developing roller, wherein each of the second spacing members has a larger outer diameter than the second developing roller;

a pair of first retaining members each of which is configured to rotatably retain a rotation shaft of the sleeve roller and a rotation shaft of the first developing roller, with a prescribed constant clearance between the magnetic roller and the first developing roller;

a pair of second retaining members each of which is configured to rotatably retain the rotation shaft of the sleeve roller and a rotation shaft of the second developing roller, wherein the second retaining members, along with the rotation shaft of the second developing roller, are swingable around the rotation shaft of the sleeve roller;

a first biasing member configured to urge the first spacing members against the image carrier; and a second biasing member configured to urge the second spacing members against the image carrier.

2. The image forming apparatus of claim 1, wherein the developing device includes:

a housing which carries the magnetic roller, the first developing roller via the first retaining members, and the second developing roller via the second retaining members, and which is configured to move toward the image carrier to bring the first spacing members in contact with the image carrier, wherein the first biasing member is configured to apply a biasing force to the housing.

3. The image forming apparatus of claim 1, wherein the magnetic roller supplies more of the toner in the developer to the first developing roller than to the second developing roller.

4. The image forming apparatus of claim 3, wherein the first developing roller is arranged upstream from the second developing roller in a direction in which the developer is conveyed on an outer circumferential surface of the magnetic roller.

5. The image forming apparatus of claim 1, wherein the first developing roller is arranged upstream from the second developing roller in a rotation direction of the image carrier.

6. An image forming apparatus, comprising:

an image carrier configured to carry an electrostatic latent image on a surface thereof; and a developing device, including:

a first developing roller and a second developing roller each configured to carry a toner layer formed on a surface thereof, wherein the electrostatic latent image on the surface of the image carrier is developed with the toner layer;

a magnetic roller which has a fixedly arranged magnetic body and a rotatable sleeve roller containing the magnetic body therein, and which is provided to be opposed to the first and second developing rollers and is configured to carry and convey developer containing toner and carrier particles on an outer circumferential surface thereof to feed the toner in the developer to the first and second developing rollers;

a pair of first spacing members each of which is provided coaxially with the first developing roller at each end of the first developing roller, wherein each of the first spacing members has a larger outer diameter than the first developing roller;

a pair of second spacing members each of which is provided coaxially with the second developing roller at each end of the second developing roller, wherein each of the second spacing members has a larger outer diameter than the second developing roller;

a pair of third spacing members each of which is provided coaxially with the sleeve roller at each end of the sleeve roller at a position at which each third spacing member can contact to the surface of the first developing roller, and each of which has a larger outer diameter than the sleeve roller;

a pair of first retaining members each of which is configured to rotatably retain a rotation shaft of the sleeve roller and a rotation shaft of the first developing roller so that the first developing roller is able to move toward and away from the magnetic roller and to contact the third spacing members;

a pair of second retaining members each of which is configured to rotatably retain the rotation shaft of the sleeve roller and a rotation shaft of the second developing roller, wherein the second retaining members, along with the rotation shaft of the second developing roller, are swingable around the rotation shaft of the sleeve roller;

a first biasing member configured to urge the first spacing members against the image carrier; and a second biasing member configured to urge the second spacing members against the image carrier.

7. The image forming apparatus of claim 6, wherein the developing device includes:

a housing which carries the magnetic roller, the first developing roller via the first retaining members, and the second developing roller via the second retaining members, and which is configured to move toward the image carrier so that the first spacing members are in contact with the image carrier and the third spacing members are then in contact with the surface of the first developing roller, wherein the first biasing member is configured to apply a biasing force to the housing.

8. The image forming apparatus of claim 7, wherein the second retaining members are configured to retain the rotation shaft of the second developing roller so that the rotation shaft of the second developing roller is able to move toward and away from the magnetic roller.

9. The image forming apparatus of claim 6, wherein the magnetic roller supplies more of the toner in the developer to the first developing roller than to the second developing roller.

10. The image forming apparatus of claim 9, wherein the first developing roller is arranged upstream from the second developing roller in a direction in which the developer is conveyed on the outer circumferential surface of the magnetic roller.

11. The image forming apparatus of claim 6, wherein the first developing roller is arranged upstream from the second developing in a rotation direction of the image carrier.

12. The image forming apparatus of claim 6, wherein the second retaining members are configured to retain the rotation shaft of the second developing roller so that the rotation shaft of the second developing roller is able to move toward and away from the magnetic roller.

* * * * *